US006202891B1

(12) United States Patent
Mark

(10) Patent No.: US 6,202,891 B1
(45) Date of Patent: Mar. 20, 2001

(54) DISPENSER FOR LIQUID APPLICATOR

(75) Inventor: Phillip Mark, Orlando, FL (US)

(73) Assignee: Microbrush, Corporation, Grafton, WI (US)

( * ) Notice: Subject to any disclaimer, the term of this patent is extended or adjusted under 35 U.S.C. 154(b) by 0 days.

(21) Appl. No.: 09/177,507

(22) Filed: Oct. 23, 1998

(51) Int. Cl.[7] ..... B65G 59/00

(52) U.S. Cl. ..... 221/196; 221/203; 221/266; 221/287

(58) Field of Search ..... 221/203, 195, 221/196, 266, 287, 197

(56) References Cited

U.S. PATENT DOCUMENTS 1,146,447 * 7/1915 Prommel ..... 221/266
1,610,001 * 12/1926 Foster ..... 221/266
2,294,979 * 9/1942 Goldberg ..... 221/266
3,587,922 * 6/1971 Oriti ..... 221/203
3,995,768 * 12/1976 Montalbano et al. ..... 221/197
5,509,522 * 4/1996 Laidlaw ..... 221/197

* cited by examiner

*Primary Examiner*—H. Grant Skaggs
(74) *Attorney, Agent, or Firm*—Eric P. Schellin

(57) ABSTRACT

A dispenser for elongated rod-like articles. The dispenser has a housing which has a trap chamber rotatable cylinder wherein the trap gravitationally captures from the bottom of a pile, one at a time, one of the rod-like articles and arcuately moves it by means of the cylinder to a downwardly facing position from whence the rod-like article falls onto a chute. The housing is loaded from a cartridge which contains the rod-like articles and is inserted on top of the housing when in use. The cylinder is constructed of a plurality of spaced apart discs each of which has a radially extending notch in alignment with one another to thereby define an elongated trap for the rod-like articles to be dispensed.

4 Claims, 2 Drawing Sheets

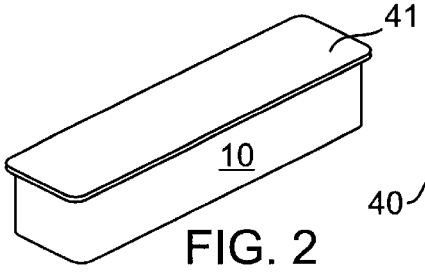
FIG. 2
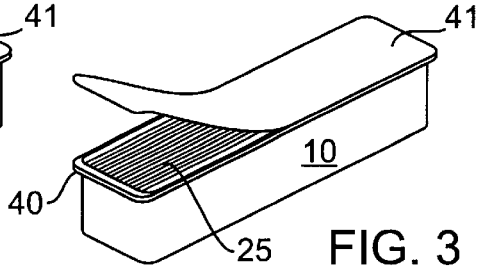
FIG. 3
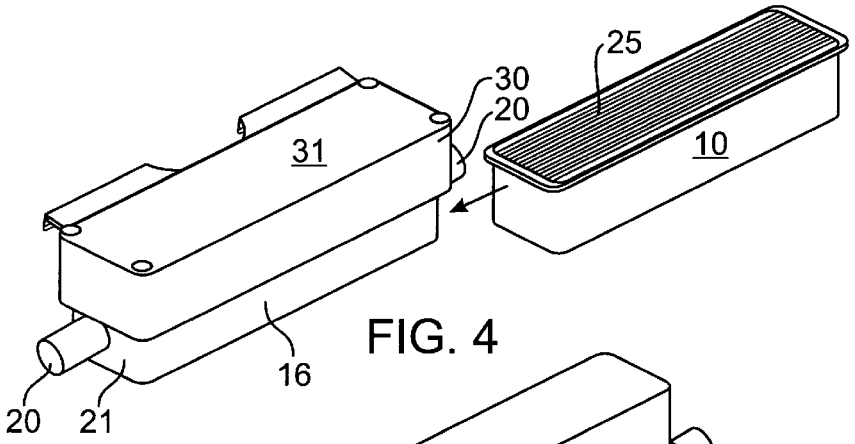
FIG. 4
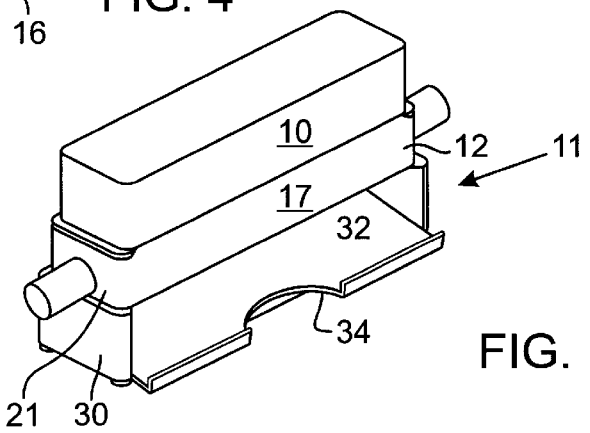
FIG. 1
FIG. 12
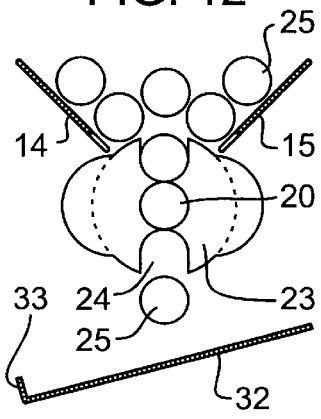
FIG. 13
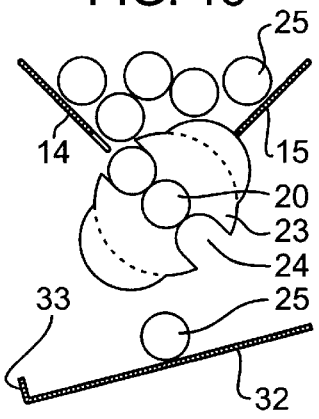
FIG. 14
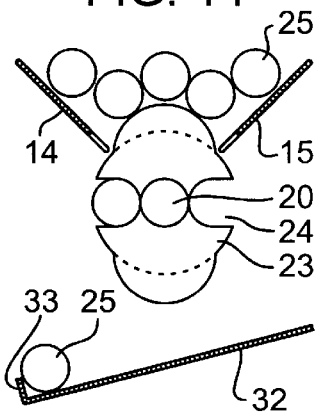

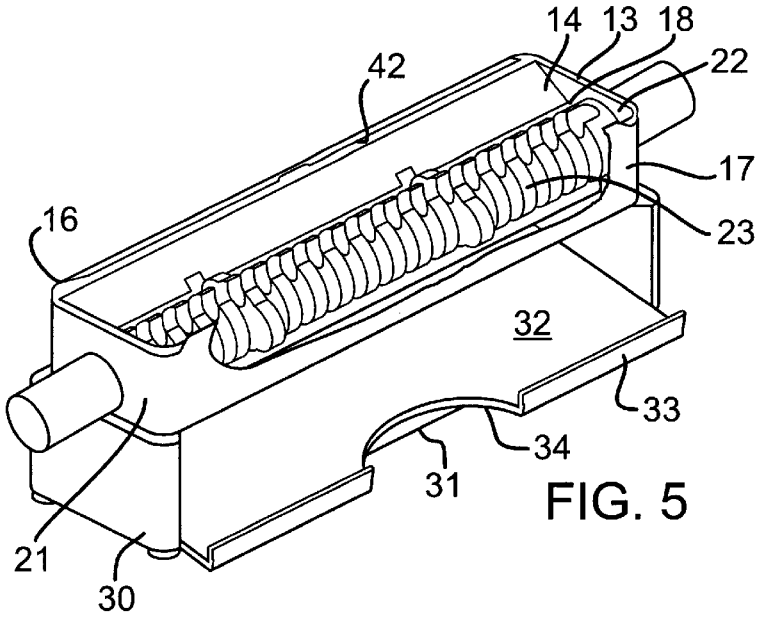
FIG. 5
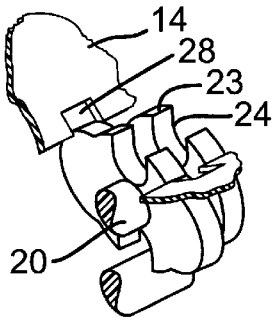
FIG. 6
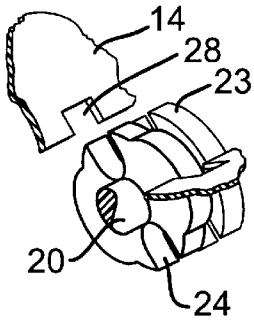
FIG. 7
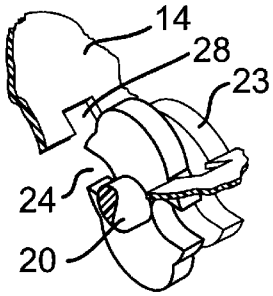
FIG. 8
FIG. 9
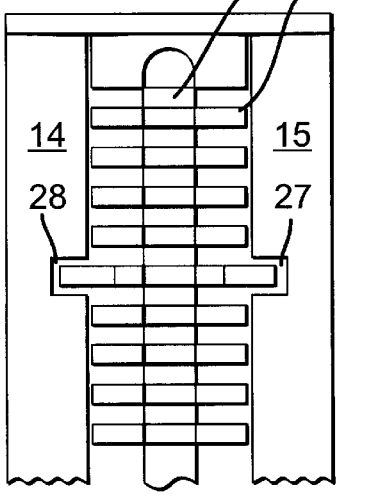
FIG. 10
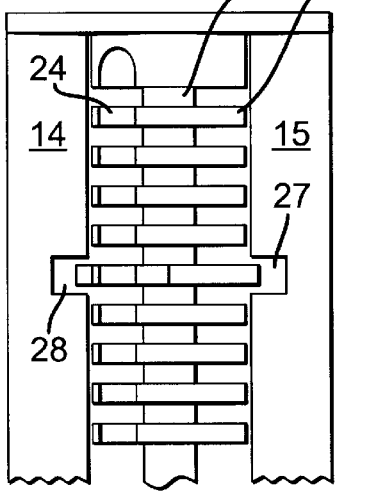
FIG. 11
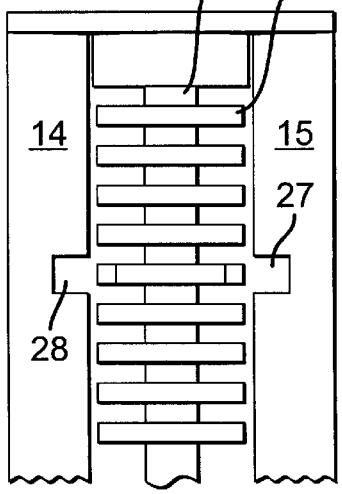

DISPENSER FOR LIQUID APPLICATOR

BACKGROUND OF THE INVENTION

A number of prior art inventions have been developed, for storing and dispensing elongated slender rod objects such as toothpicks. Many of such devices can be found at the cashier's counter of restaurants. One of such devices is embodied and disclosed in U.S. Pat. No. 2,004,805 to D'Agostino. The patentee discloses a toothpick dispenser having a receiving chute 43 which terminates in an abutment 46, the chute and abutment have a cut away 45 whereby the toothpick may easily be removed.

Usually, the dispensers for elongated slender rod objects provide for a magazine type reservoir which terminates in a bottom having sloping walls. The sloping walls ends about a cylinder parallel to the supply of rods. The cylinder will have one or more elongated traps which are elongated grooves in the cylinder adapted and constructed to accommodate a rod which falls thereinto when the trap is presented at or near the bottom of the stockpiled rods. The cylinder is rotated to a position whereby the trap is inverted over a chute and the rod falls therefrom, rolls down the chute to a discharge and manual pick up position. Exemplary of such devices can be seen from U.S. Pat. No. 1,212,357 to Jackson and U.S. Pat. No. 2,387,470 to Seegar et al.

A much more recent device of such a nature can be seen from U.S. Pat. No. 5,509,522 to Laidlow who shows a dispenser for elongated slender rod articles wherein a supply of slender rod articles are housed in a transparent cartridge which is then inverted to be positioned on a dispenser. Sloping walls direct the slender rod articles to an apex in which a rotatable cylinder is located. The cylinder has thereon oppositely disposed trap chambers for picking up a rod article, then carrying into a position for gravity discharge therefrom.

SUMMARY OF THE INVENTION

The present invention is to a dispenser for elongated slender liquid applicators. The applicators comprise a handle portion and a knob at one end. The knob has flocked bustle-like fibers thereon. The dispenser is mounted with a replaceable transparent cartridge storage container which is filled with applicators having one end open upon which a film membrane is removably secured to the leading edge of the opening. The membrane is removed when the cartridge is in a position where the opening is facing upwardly.

The dispenser is positioned upside down and the cartridge is slid into retaining place from one side. The dispenser with the now in place cartridge is rotated 180° ready for operation in its dispensing mode. The dispenser has a horizontal rotatable cylinder with two elongated applicator trapping chambers on opposite sides. The cylinder consists of a plurality of spaced apart discs on an elongated axle. At least two of the discs have radially outwardly extending camming surfaces that rotatably enter into slots spaced apart in downwardly sloping walls at the bottom apex wherein the cylinder is located. The camming surfaces prevent jamming of the applicators as they fall into place in the oppositely disposed trap chambers for dispensing. As the trap cylinder rotates 180° in either direction it carries an applicator to a position whereby it falls away from the trap cylinder into a chute. The chute terminates in an apron portion which extends somewhat horizontally at the bottom portion of the dispenser. The dispensed applicator becomes lodged against an abutment at the end of the chute from whence it may be plucked for use. When the cartridge is empty it may be removed and a new filled cartridge may be substituted therefor.

BRIEF DESCRIPTION OF THE DRAWINGS

FIG. 1 is a perspective view of the dispenser of the present invention with an applicator cartridge in place;

FIG. 2 is a perspective upside down view of the applicator containing cartridge which is to be loaded onto the dispenser, FIG. 3 is similar perspective view of the cartridge of FIG. 2 with its cover partially removed;

FIG. 4 is a perspective upside down view of the dispenser ready to accept the to be slid into place applicator loaded cartridge with its cover entirely removed;

FIG. 5 is a perspective view of the dispenser with a part of its front wall broken away to show the structure of dispensing the trap chamber without the cartridge;

FIG. 6 is a close up fragmentary detail view of the dispensing trap chamber;

FIG. 7 is a close up fragmentary detail as in FIG. 6 wherein the trap chamber has been rotated through an angle;

FIG. 8 is a close up fragmentary detail as in FIGS. 6 and 7 wherein the trap chamber has been rotated through a great angle than shown in FIG. 7;

FIGS. 9, 10 & 11 are top fragmentary views of the trap chamber showing the chamber in a progression of arcuate movements;

FIGS. 12, 13 and 14 are a somewhat schematic fragmentary and cross-sectional view showing the dispensing trap chamber in operation.

DETAILED DESCRIPTION OF THE INVENTION

The dispenser of the present invention is shown, generally, by reference number 11. The dispenser 11 is top fitted with a transparent rectangularly shaped cartridge 10. The dispenser has a rectangularly shaped housing 12 as can best be seen especially from FIG. 5. The housing 12 has a rectangular shaped upwardly facing opening 13. The housing has elongated downwardly sloping bottom walls 14 and 15 extending from the longest sides 16 and 17 of the housing 12 to form a slot 18.

An axle 20 is located in the slot 18. The axle 20 extends through the housing 12 and protrudes out of the shorter end walls 21 and 22 of the housing 12. The axle 20 has a plurality of spaced apart discs 23 integral with the axle 20 of somewhat a larger diameter than the axle 20.

The discs 23 each have at least one radial aligned notch 24 so that together they form a trap chamber into which elongated rod-like elements 25 gravitationally fall which are normally stored in the cartridge 10 along the sloping walls 14 and 15 of the housing 12 best seen in FIGS. 12, 13 and 14.

At least two of the discs 23 have radially extending extensions 26 which are detailed to extend into notches 27 and 28 cut into the sloping walls 14 and 15, respectively. These extensions 27 and 28 are designed to prevent clogging of area around the sloping walls 14 and 15 with a possible build up of the rod-like articles.

The housing 12 has a downwardly extending U-shaped portion 30 which terminates in a bottom 31. A sloping chute 32 is mounted at the topside of the bottom 31 and extends through the opening defined by the U-shaped portion 30 and is below wall 17. The chute 32 terminates beyond the U-shaped portion 30 in an abutment 33, designed to hold the rod-like articles 25 being dispensed as shown best in FIG. 14

The chute 32 has a notch 34 to provide therewith easier manual pick up of the rod-like articles 25.

The housing of the dispenser is easily loaded from a filled cartridge 10 containing the rod-like articles. FIG. 2 shows a cartridge 10 in an upside position. The cartridge consists of a rectangularly shaped receptacle having an outwardly extending flange 40 to which a film cover 41 is adhesively secured which has been partially lifted away, as seen from FIG. 3. FIG. 4 shows the continuation of the loading process. The housing 12 is inverted and the cartridge 10 is slid longitudinally whereby the flange 41 slides into groove 42 on both edge portions of walls 16 and 17. The grooves 42 are inwardly facing flanges. Once the cartridge 10 has been slid into place, the housing 12 is turned over to its normal position as shown in FIG. 1. The rod-like to be dispensed articles gravitationally fill the space defined by the sloping walls 14 and 15. The axle 20 is turned at either of its ends to present a notch 24 whereinto a rod-like article falls. The axle is continued to be rotated thereby carrying the captured rod-like article, as shown in FIGS. 12, 13 and 14, until the notches of the discs are disposed downwardly and the rod-like articles fall free of the said notches onto the surface of chute 32.

When all of the rod-like articles have been dispensed, the cartridge 10 is slid away from the housing 12. The housing 12 may be re-loaded with a new filled cartridge 10 when the housing 12 is in an inverted position as in FIG. 4.

The housing may be constructed by injection molding of a conventional thermoplastic material. The cartridge may be transparent, thereby revealing the quantity of rod-like articles remaining before requiring replacement with a filled cartridge 10.

What is claimed is:

1. A dispenser for elongated slim rod-like articles comprising a separable reservoir cartridge for containing a plurality of elongated slim-rod-like articles;

said reservoir cartridge having a downwardly facing opening through which said rod-like articles gravitate;

said dispenser having an upwardly open facing housing;

said upwardly open facing housing having an edge portion having, means for slidably mating means on said downwardly facing opening of said cartridge to matingly retain said cartridge and said housing;

said housing having spaced end walls;

said housing having an elongated funnel means between said end walls;

said funnel means having elongated two walls sloping towards each other terminating in a slot;

a dispensing trap chamber containing cylinder means rotatable mounded in said slot between said end walls;

said cylinder means being constructed of a plurality of spaced apart discs axially aligned an axle;

said dispensing trap chamber being defined by aligned cut out portions of said discs;

at least two of said discs having outwardly radially extending portions;

said sloping walls having oppositely facing slots adapted and constructed to accept therein said extending portions as said cylinder means is rotated;

said housing having a receiving chute mounted below said cylinder means whereby said rod-like article may be gravitationally received from said dispensing trap chamber when said cylinder means is rotated.

2. The dispenser of claim 1 wherein the receiving chute has a cut out portion whereby said rod-lie articles may be manually removed.

3. The dispenser of claim 2 wherein the receiving chute terminates in an abutment means against which the rod-like articles may lodge.

4. The dispenser of claims 1, 2 or 3 wherein the upwardly facing housing edge portion is rectangularly shaped, the said edge portion has slots running around three of the edges, said cartridge has a outwardly extending flange about its downwardly facing opening, said slots and said flange adapted and constructed to mate to thereby retain said cartridge together with said housing.

* * * * *